United States Patent [19]

Schijf

[11] 4,315,345

[45] Feb. 16, 1982

[54] PROFILED HINGE JOINT

[76] Inventor: Hendrikus J. Schijf, 2 Kraatsweg, 6732 Am Harskamp, Netherlands

[21] Appl. No.: 109,365

[22] Filed: Jan. 3, 1980

[51] Int. Cl.[3] ..... E05D 7/10; E05D 1/06

[52] U.S. Cl. ..... 16/267; 16/178; 16/DIG. 1; 16/DIG. 29

[58] Field of Search ..... 16/172, 178, DIG. 13, 16/DIG. 1, DIG. 29; 403/364, 282, 278

[56] References Cited

U.S. PATENT DOCUMENTS 2,302,661 11/1942 Benson ..... 16/178
3,648,328 3/1972 McCabe ..... 16/178

FOREIGN PATENT DOCUMENTS 2826614 12/1979 Fed. Rep. of Germany ..... 16/178
7807254 1/1980 Netherlands ..... 16/178

*Primary Examiner*—Wayne L. Shedd
*Attorney, Agent, or Firm*—Alan H. Levine

[57] ABSTRACT

A profiled hinge joint having joint wings designed in the form of profiled frame members, one joint wing being provided with a bead member extending longitudinally with the frame member, the other joint wing having a partially open, cap-shaped flange engaging the bead member and likewise extending longitudinally with the frame member.

8 Claims, 9 Drawing Figures

PROFILED HINGE JOINT

BACKGROUND OF THE INVENTION

The invention relates to profiled hinge joints made of extruded aluminum frames having a bead means closed in longitudinal direction and a cap-shaped flange fitting around the bead means and having an open portion over a certain angle. These profiled hinge joints, which are used for roller shutters, greenhouse windows, letter boxes and the like, are so designed that they can slide into each other in the longitudinal direction of the joint wings which are designed in the form of profiled frames.

SUMMARY OF THE INVENTION

It is an object of the present invention to improve the construction of such a profiled hinge joint in such a manner that also relatively large panels are easily capable of engaging each other without having to slide the profiled frame members into each other in longitudinal direction, said panels now being engageable with each other in a certain position. This offers the advantage that, for instance in the case of lifting doors, the panels may be easily mounted.

According to the present invention, this object is attained by utilizing a profiled hinge joint of the type as described hereinbefore wherein the bead member, on the side remote from the frame member, has been provided with a partially restricted part and the cap-shaped flange possesses a slot of such a width that the bead member is to be laterally inserted into the cap-shaped flange with an angle outside the hinging field of both frame members with respect to each other. Further the frame member provided with the bead has at least two flanges disposed at right angles to each other and the bead has been positioned near one of the flanges.

This presents the advantage that when the bead is surrounded by the shell type member formed at one corner of the belonging frame member, both joint wings formed by the frame members are in complete alignment with respect to each other.

According to another object of the present invention the bead member, on the side facing the frame member, being partially surrounded by a shell-type member forming part of the frame member, there being located between the shell and the bead member a chamber for receiving the cap-shaped flange.

This presents the advantage that the cap-shaped flange is entirely enclosed and is capable of performing, both outside and inside, a supporting function. Moreover, the advantage of having a good, wind-proof joint is thus obtained.

According to the invention, a practical embodiment of the profiled hinge joint consists in that the frame member provided with the bead member has at least two flanges disposed perpendicular to each other and in that the shell forms the connection between the two said flanges, the bead member being connected with one of the two flanges and the chamber surrounding the bead member like a section of a cylindrical housing, the cap-shaped flange being formed in the vicinity of the line of intersection of two frame flanges disposed at an angle with respect to each other.

BRIEF DESCRIPTION OF THE DRAWINGS

The invention will now be illustrated by way of example with reference to the accompanying drawings, in which.

DESCRIPTION OF PREFERRED EMBODIMENTS

In the case of lifting doors, which do not have enough space above the door opening, guide rails are used which are curved above the door, in which case the door is composed of panels 1 being hingedly attached to each other. At the location of the hinge joints there are mounted on the side edges of the doors, rollers 2 which are adapted to fit into the guide rails 3*a* and 3*b*.

Figure 1:
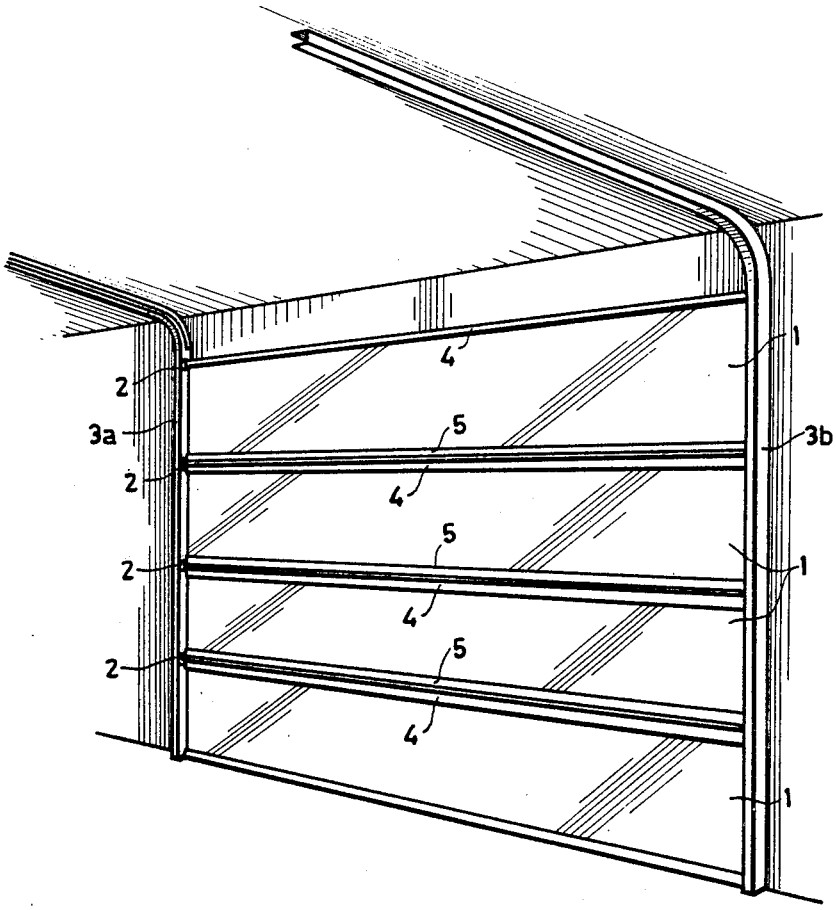
FIG. 1 is a perspective view of a lifting door provided with profiled hinge joint members in accordance with the invention.
Figure 2:
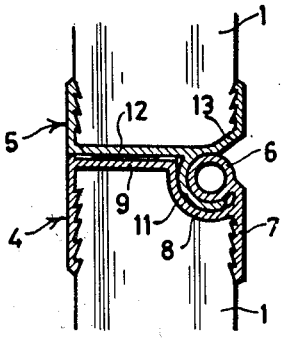
FIG. 2 is a cross-sectional view of a profiled hinge joint as disposed between two panels of the lifting door shown in FIG. 1.

As is clearly visible in FIG. 1, the guide rails 3*a* and 3*b* change into a curved portion mounted to the ceiling or other holding means. When lifting the door, the panels 1, while moving, assume different positions with respect to one another until they have arrived in the curved portion when the door has been opened completely.

To this end the panels 1 are provided with profiled hinge joints in the form of a profiled lower frame 4 and a profiled upper frame 5.

The manner in which the door is elevated, for example by means of a drive mechanism, will not be specified as this does not form part of the subject-matter of the present invention.

The lower frame 4 is provided with a hollow bead member 6 being connected with a side flange 7 of the frame 4.

Figure 3:
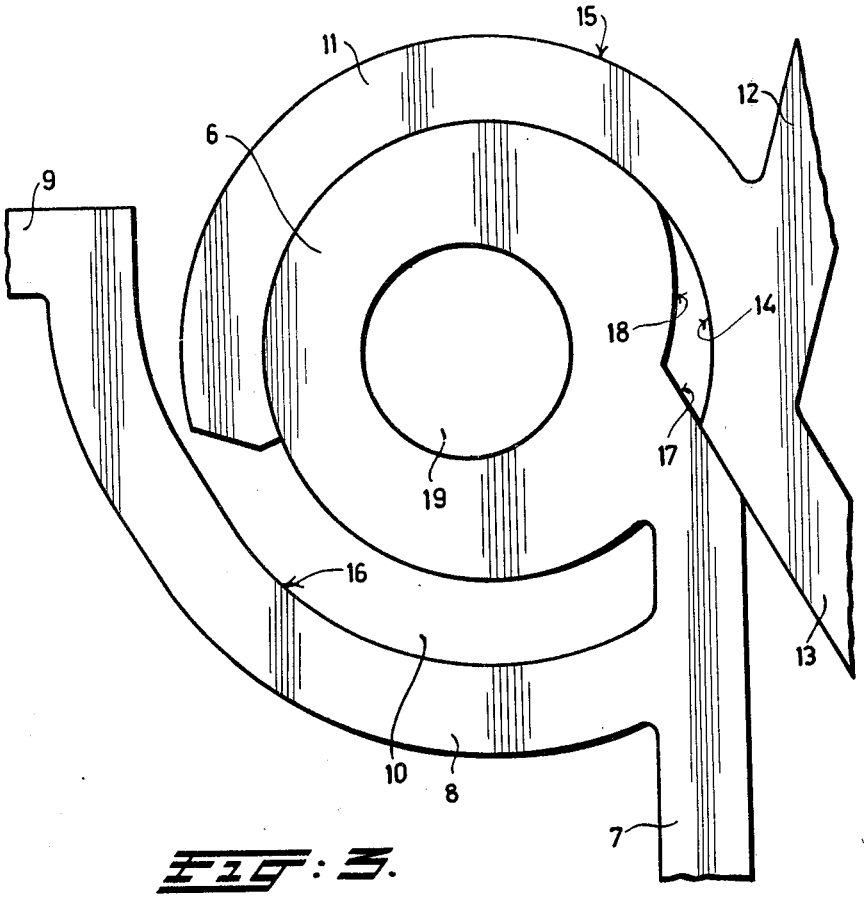
FIG. 3 is a greatly enlarged, cross-sectional view of a detail in FIG. 2.
Figure 4:
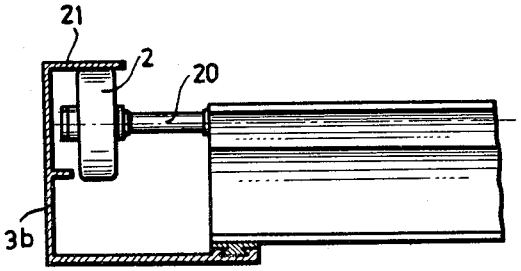
FIG. 4 is a plan view of a profiled hinge joint member mounted in a lifting door, having a roller in a guide rail.

The bead member 6 is disposed stepped relative to the flange 7 and has a slanted area 17. A portion of the outer wall of the bead member 6 has a restricted area for a purpose to be described hereinafter. This restricted portion is referenced 18 in FIG. 3. The radius of said recess 18 runs from a centre differing from that of the radius of the remaining portion of the bead member 6. In addition, the bead member 6 is in longitudinal direction provided with a bore 19 for receiving a pin 20 of a roller 2 (FIG. 4).

The bead member 6 is surrounded by a shell 8 forming the connection between the flange 7 and the flange 9 of the frame 4. A chamber 10 being open at location of the flange 9, vide in particular FIG. 3, is thus formed around the bead member 6.

A cap-shaped flange 11 of the profiled frame member 5 is adapted to fit around the bead member 6 and in the chamber 10. Said cap-shaped flange 11 is located between two flanges 12 and 13 of the frame member 5 which are disposed at an angle with respect to each other.

The cap-shaped flange 11 has a relatively large, open portion so as to enable the frame member 5 to engage the frame member 4 while still ensuring an adequate supporting function of the cap-shaped frame 11, since the latter fits with its inner wall 14 around the bead member 6 and rests with its outer wall 15 against a wall 16 of said chamber 10.

When positioning a panel 1 between the rails, its cap-shaped flange 11, is disposed upon the bead member 6 and slid inwards, the pin 20 being pushed tighly with its roller against the frame 5, so that the panel can be pressed between the rails 3*a* and 3*b*. Thereupon, the roller with the pin is slid outwards to beyond a flange 21 of the rails 3. The pin 20 is subsequently secured in the opening 19 of the bead member 6 by means of a tension pin or a locking screw.

Figure 5:
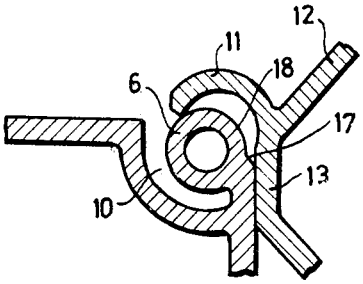
FIGS. 5-8 are sectional views, as shown in FIG. 3, wherein the joint wings are in different positions with respect to one another.
Figure 6:
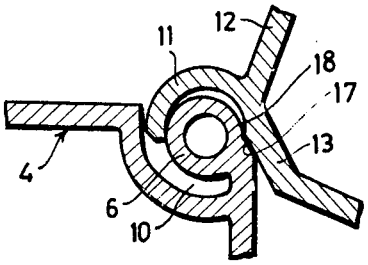

FIG. 5 shows the profiled hinge joint in the situation occurring at the moment when a panel 1 is brought into position above another panel. Firstly the hinge joint is snapped in, whereby the area connecting the cap-shaped flange 11 to the flange 13 will fit in the recess 18 with the slanted section 17, as shown in FIG. 6. The cap-shaped flange 11 thus penetrates into the chamber 10 of the profiled frame 4, also because of the chamber 10 having a widened section in the vicinity of the flange 9.

Figure 7:
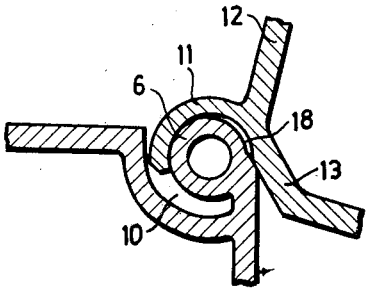
Figure 8:
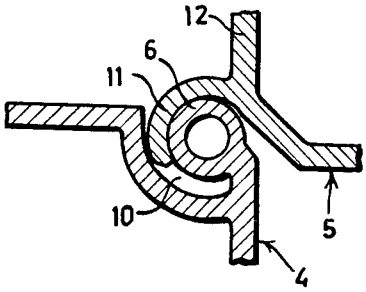
Figure 9:
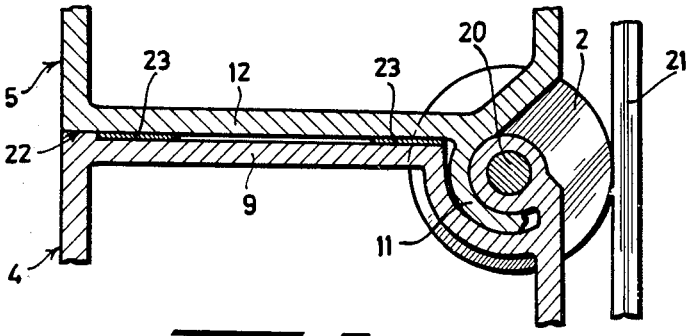
FIG. 9 is a section, identical to the one in FIG. 2, wherein a roller has been mounted in the hinge joint member.

FIG. 7, shows that on continuing the swinging movement, the inner wall of the cap 11 comes into a closer position around the bead member, thus detaching the recess 18 from the wall of said cap-shaped flange 11. Thus, the frame members 4 and 5 are positioned with respect to one another so that they can move in an articulated manner in relation to each other, for example from a square position as shown in FIG. 8, to a closed position as shown in FIG. 9. The frame member 4 has a shoulder 22 for abutment of the frame member 5. As a result, draught strips 23 can be arranged between the flanges 12 and 9 so that, a door comprising panels 1 provides a good, wind-proof seal in a closed position. The roller 2 is then resting against the flange 21 of a guide rail 3*a* or 3*b*.

What is claimed is:

1. A hinge joint including first and second cooperable hinge members,

I. The first hinge member comprising:

(a) an elongated frame adapted to be attached to a first part to be hinged, and (b) a bead extending longitudinally along the frame, the bead having a substantially circular cross-sectional shape, and the bead having a recess in its exterior surface, the recess extending for the length of the bead, and II. the second hinge member comprising:

(c) an elongated frame adapted to be attached to a second part to be hinged to the first part, and (d) a concave channel extending longitudinally along the frame (c), the channel being sized to rotatably accommodate the bead within it, the channel having a longitudinal opening of a width such that when one longitudinal edge of the opening is located in the recess of the bead, the bead can pass between the longitudinal edges of the opening into the channel to assemble the hinge members, and when the hinge members are thereafter relatively rotated so that the one edge of the opening is out of registry with the recess, the bead cannot pass between the longitudinal edges of the opening, whereby the hinge members remain assembled in relatively rotatable condition.

2. A hinge joint according to claim 1 wherein the frame of the first hinge member includes two mutually perpendicular flanges, the bead being located near the line of intersection between the frame flanges.

3. A hinge joint according to claim 2 wherein the bead includes a slanted portion extending at an angle to one of the frame flanges, the slanted portion extending into the recess of the bead.

4. A hinge joint according to claim 2, including a shell partially surrounding the bead, the shell interconnecting the two legs of the frame and defining between itself and the bead a chamber for slidably receiving the channel of the second hinge member.

5. A hinge joint according to claim 4 wherein the chamber has an increased width at its open end adjacent to one of the frame flanges.

6. A hinge joint according to claim 1 wherein the concave channel of the second hinge member has the shape of a partial circular cylinder, the channel extending for more than one-half the circumference of the cylinder.

7. A hinge joint according to claim 1 wherein the frame of the second hinge member includes two flanges which meet at an obtuse angle, the channel being located near the line of intersection of the frame flanges.

8. A hinge joint according to claim 1 wherein the internal radius of the channel is about equal to the external radius of the bead in the region not having the recess.

* * * * *